United States Patent [19]

Ploeger

[11] 3,951,499

[45] Apr. 20, 1976

[54] ELECTRIC LAMP MOUNTING ASSEMBLY

[75] Inventor: Kenneth C. Ploeger, Blue Springs, Mo.

[73] Assignee: Rupert Manufacturing Company, Blue Springs, Mo.

[22] Filed: Aug. 12, 1974

[21] Appl. No.: 496,917

[52] U.S. Cl. ..... 339/59 L

[51] Int. Cl.[2] ..... H01R 13/48

[58] Field of Search ..... 339/17 D, 59 L, 61 L, 339/88, 127, 181, 189–190

[56] References Cited

UNITED STATES PATENTS

| | | | |
|---|---|---|---|
| 2,941,182 | 6/1960 | Heller | 339/188 R |
| 3,198,462 | 8/1965 | Schultz | 339/127 R |

FOREIGN PATENTS OR APPLICATIONS

| | | | |
|---|---|---|---|
| 2,006,291 | 8/1971 | Germany | 339/88 R |

*Primary Examiner*—Joseph H. McGlynn
*Attorney, Agent, or Firm*—E. Dennis O'Connor

[57] ABSTRACT

An assembly for mounting an electric lamp bulb of the type adapted to mate with a bayonet coupling. The assembly includes a one-piece housing of insulating material that completely surrounds a portion of the bulb base. For insulation of the bulb from vibration and to reduce the likelihood of corrosion, metal to metal contact involving the bulb is minimized. A biasing force provided by the resilient deformation of the housing material is used to provide electrical contact between an electrical lead and a bulb base terminal despite the fact that the housing material is semi-rigid.

7 Claims, 5 Drawing Figures

ELECTRIC LAMP MOUNTING ASSEMBLY

BACKGROUND OF THE INVENTION

The art relating to small electric lamp bulb sockets and bulb mounting assemblies long has recognized certain requisite design parameters such as the need to accommodate easy bulb replacement and the desirability of minimizing the number of assembly parts. This latter consideration contributes greatly to minimizing the total cost of manufacture of what commonly is a high volume production product. It has proven complex to obtain these design goals in the case of bulb mounting assemblies that are subjected to corrosive atmospheres and excessive vibrations, such as assemblies used on the exteriors of vehicles as running lights, while maintaining reliability of function for both the mounting assembly and the lamp bulb mounted therein.

One expedient that is known in the art is the formation of the mounting assembly housing as a one-piece molding from electrically insulating material such as rubber or flexible plastic. Examples of this are disclosed by U.S. Pat. No. 2,099,405 issued Nov. 16, 1937, U.S. Pat. No. 2,741,747, issued Apr. 10, 1956, and U.S. Pat. No. 3,182,279, issued May 4, 1965. Assembly housings as taught by these patents reduce the number and complexity of assembly parts. Also, in the case of U.S. Pat. Nos. 2,099,405 and 3,182,279, the resiliency of the housing material is exploited to eliminate the need for a spring part often used to bias an electrical lead into current transmitting contact with the terminal at the extremity of the bulb base.

Use of devices as taught by these patents on the exterior of vehicles and in like environments does pose, however, certain potential difficulties. While the prior art molded housings greatly reduce the transmission of vibrations through the mounting assemblies to the bulb as compared to assemblies having metal housings, substantial metal to metal contact between parts functioning as electrical leads and the bulb base still serves to transmit deleterious vibrations to the bulb filament which shorten the useful life of the bulb. Such substantial metal to metal contact and the proximity of metal to the bulb base also give rise to the distinct possibility of oxidation in the corrosive atmosphere of vehicle usage, making removal of the bulb difficult or impossible at the time bulb replacement is necessary.

Additionally, in order that the materials of the prior art molded housings be sufficiently resilient to provide the desired biasing force between an electrical lead and the bulb base terminal such materials commonly are relatively soft and flexible elastomers. Because of their softness and flexibility, such materials have a tendency to wear at interfaces with vehicle mounting structure because of vibrations and offer little protection to the enclosed bulb in the event the assembly housings are impacted by stones, gravel or because of slight collisions with structures such as fences, walls or other vehicles. Such collisions often may happen since running lights commonly are positioned at the exterior limits of vehicles.

It is, therefore, an object of this invention to provide an electric lamp mounting assembly that includes a one piece housing of insulating material in order to minimize the number of assembly parts and provide for ease and economy of manufacture. A further object of the invention is to provide a mounting assembly of a design that minimizes to the greatest extent possible metal to metal contact involving the mounted bulb to reduce the chances of corrosion involving and proximate the bulb. A still further object is to insulate the bulb to a large extent from vibrations occurring in surrounding structure to which the assembly is attached. Additionally, it is an object of the invention to eliminate the need for a spring part urging an electrical lead into contact with the bulb terminal by utilizing a biasing force provided by the resilient deformation of the housing material itself, while still using a semi-rigid, wear and impact resistant housing material. All of these objects are provided while retaining a simple and easily accomplished bulb mounting and removal arrangement together with reliability of electrical functioning for the assembly parts.

SUMMARY OF THE INVENTION

An electric lamp assembly according to this invention is adapted for mounting an electric bulb having a globe, a cylindrical base, a base terminal insulated from the base and a pair of conductive studs extending radially from the base. The assembly includes an insulating housing formed from a semi-rigid material and having a base portion and a sleeve portion interconnected with the base portion. The sleeve is adapted to receive telescopically the cylindrical bulb base and completely surround a portion of the bulb base in closely contiguous relationship thereto. The sleeve has a pair of longitudinal slots formed therein, each of which is adapted to receive one of the bulb base studs. A first electrical conductor is positioned in one end of the sleeve by resilient means integral with the housing. This electrical conductor is adapted to be urged into contact with the bulb base terminal by the resilient means and is adapted to the interconnected with a source of electrical energy. A second electrical conductor at least partially surrounds the sleeve and includes a pair of projections, one of which extends into each of the slots and is engaged by one of the studs. Electrically conductive fasteners secure the second connector to the housing base and are adapted to interconnect the second conductor to an electrically grounded element.

DETAILED DESCRIPTION OF THE INVENTION

Figure 1:
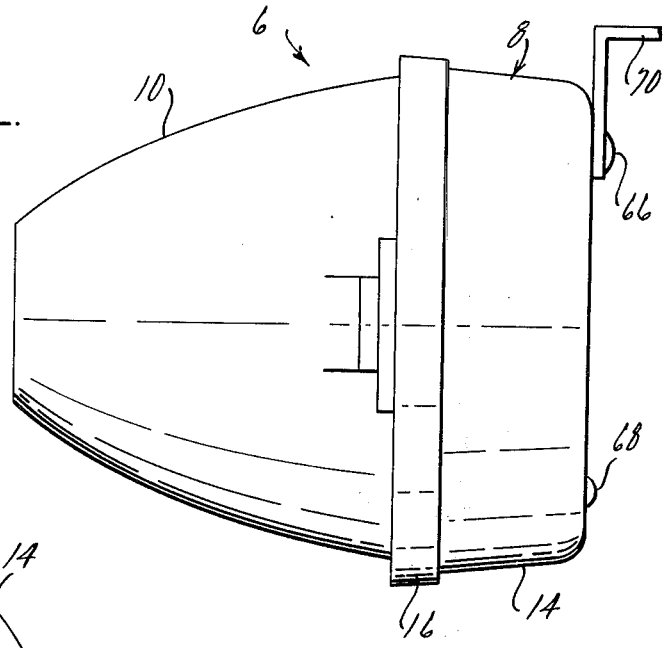
FIG. 1 is a side elevation view of an electric lamp assembly constructed in accordance with the invention.
Figure 2:
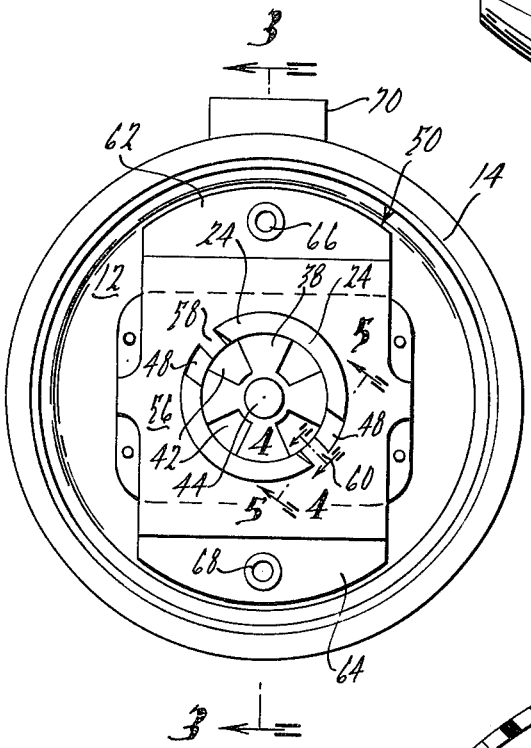
FIG. 2 is a front view of the assembly of FIG. 1 with the lens member removed to show interior parts.
Figure 3:
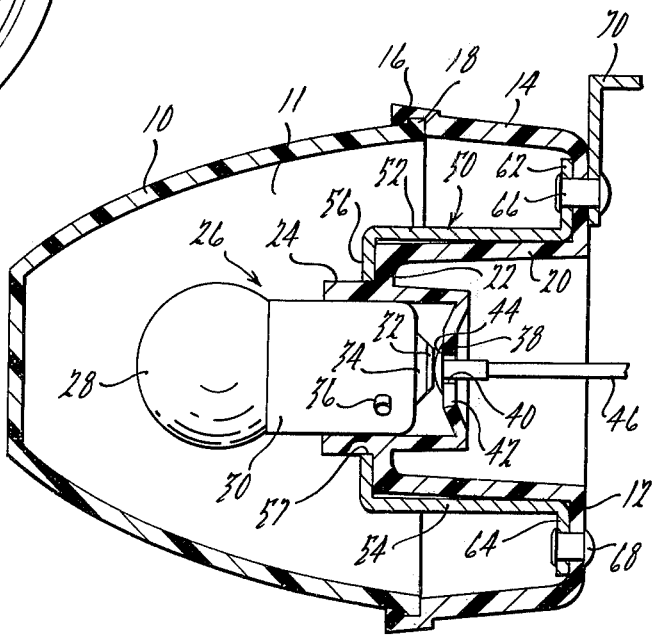
FIG. 3 is a section view taken along the line 3—3 of FIG. 2 and including the assembly lens member.

Referring now in detail to the drawing, and in particular to FIGS. 1–3 thereof, the number 6 denotes generally a lamp mounting assembly constructed in accordance with this invention. The assembly 6 includes an integral, one-piece housing 8 described in detail below and a transparent or translucent lens 10 that cooperates with housing 8 in defining an enclosed space 11 in which the bulb to be mounted is positioned.

Housing 8 may be integrally molded from synthetic, electrical insulation material of a semi-rigid nature, such as polypropelene. The configuration of housing 8 includes a base 12 and a generally cylindrical side 14 extending from the base 12. The extremity of side 14 remote from base 12 is formed into a C-shaped rim 16. A shoulder 18 extending from the free end periphery of lens 10 is received removably within the groove of the C-shaped rim 16 to lock housing 8 and lens 10 together.

Housing 8 further includes an inner cylindrical portion 20 that extends from base 12 generally parallel and coaxial with the side 14. The end of portion 20 remote from base 12 is interconnected by a web portion 22 with a central sleeve 24 that extends generally parallel to and coaxial with portion 20.

A conventional electrical lamp bulb is identified generally by the number 26 and is mounted by the assembly 6 within enclosed space 11. Bulb 26, as is well known in the art, includes a globe 28, electrically conductive base 30 and a base terminal 32 separated from base 30 by insulating material 34. Electrically conductive studs 36 extend radially from base 30. Such studs conventionally are utilized in cooperation with a bayonet coupling to secure the bulb in place. The manner in which bulb 26 is mounted by assembly 6 and placed in electrical circuit will be described in detail below.

As readily is apparent from FIG. 3 of the drawing, bulb base 30 partially is telescopically received in the outer end of sleeve 24. The other end of sleeve 24 is closed by an integrally molded end wall 38 having a central aperture 40 extending therethrough. End wall 38 has a domed configuration as may be seen from FIG. 3 such that it extends into sleeve 24 in a somewhat convex orientation as viewed from within the sleeve. A plurality of interstices or openings 42 are formed through end wall 38. By the removal of material of end wall 38 due to the formation of openings 42, the structural strength characteristics of the semi-rigid material of housing 8 are weakened and the semi-rigid material is made capable of resilient deformation in the area of end wall 38 in response to a relatively small deforming force.

This capability of resilient deformation of end wall 38 is utilized to provide abutting electrical contact between a conventional button terminal 44 and bulb base terminal 32. Button contact 44 is positioned within sleeve 24 against end wall 38 and is secured, as by crimping or other conventional means, to insulated wire lead 46 that extends through aperture 40 of end wall 38. Lead 46 is adapted to be interconnected with a source of electrical energy.

A pair of longitudinally extending slots 48 are formed in the wall of sleeve 24 and are open at the end of the sleeve. Slots 48 are diametrically opposed and are adapted to receive studs 36, thus permitting the telescopic insertion of bulb base 30 within sleeve 24.

An electrically conductive member is indicated generally by the number 50 and may be formed from sheet metal by stamping or other conventional forming techniques. Conductor 50 is generally U-shaped and includes a pair of side walls 52 and 54 interconnected by an end wall 56. Wall 56 has an opening 57 formed therethrough through which extends sleeve 24 to the extent that conductor wall 56 abuts web 22. A pair of projections 58 and 60 integrally are formed with conductor 50 and extend into the end wall opening 57. Projections 58 and 60 are located such that they project into the slots 48 formed in sleeve 24. Sides 52 and 54 of conductor 50 terminate in feet 62 and 64, respectively, these feet are secured to housing base 12 by electrically conductive fasteners such as rivets 66 and 68. At least one of the rivets extends through conductor foot 62 and housing base 12 and secures the assembly 6 to an electrically conductive mounting bracket 70 exterior of the assembly 6. Bracket 70 is adapted to be connected to electrical ground.

Figure 4:
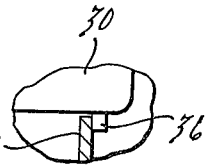
FIG. 4 is a partial section view taken along the line 4—4 of FIG. 2.
Figure 5:
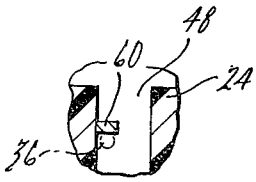
FIG. 5 is a partial section view taken along the line 5—5 of FIG. 2.

From the above description of assembly 6, it may be seen that bulb 26 may be mounted by inserting the bulb base 30 within sleeve 24 with studs 36 aligned with slots 48. The width of slots 48 is greater than the combined width of studs 36 and projections 58 and 60 so that studs 36 may pass projections 58 and 60 within slots 48. The relative dimensions of the parts are such that in order for studs 36 to pass projections 58 and 60, sufficient axial force must be applied to bulb 26 so that contact between base terminal 32 and button 44 results in a resilient deformation of end wall 38. A slight rotation of bulb 26 then results in studs 36 being located in slots 48 below projections 58 and 60. Such a location for a stud 36 below projection 60 is shown in FIG. 4 and in phantom in FIG. 5.

Resiliently deformed end wall 38 exerts a biasing force against bulb 26 urging studs 36 into contact with projections 58 and 60 which hold the bulb within the sleeve 24 in a conventional bayonet coupling arrangement. The resilient force of end wall 38 is sufficient that the frictional engagement between the studs and the conductor projections prevents rotation and loosening of bulb 26 during operation of a vehicle upon which the assembly 6 is mounted. Removal of bulb 26 requires only an inward force on the bulb to slightly deform end wall 38 and a slight rotation of the bulb so that studs 36 clear projections 58 and 60 and freely can pass out of slots 48.

It is important to note that bulb 26 is in electrical circuit in assembly 6 with only a minimum of metal to metal contact between the bulb and attendant structure. Electrical energy passes from lead 46 through contact 38 to bulb base terminal 32. The return to ground is through studs 36, projections 58 and 60, the body of conductor 58, fastener 56 and bracket 70. The only metal to metal interface involving or proximate the bulb base is between studs 36 and projections 58 and 60. This interface is substantially point contact and, while sufficient to provide requisite electrical interconnection, provides only a minute opportunity for the formation of corrosion. Thus, the lamp mounting assembly described above utilizes the bulb base studs in a conventional bayonet coupling mounting and also utilizes the studs as the only elements by which the bulb base is placed in electrical circuit.

Other advantages are made possible by this minimum metal to metal contact between electrical conductors and the bulb 26. The absence of significant metal contact with the bulb base allows the entire periphery of the base to be in contact with the material of sleeve 23. This material acts as a dampening agent and inhibits the transmission of road vibrations to the bulb and thus to the bulb filament as compared to bulb mounting schemes wherein the existence of more extensive metal to metal contact is tolerated. Additionally, even if corrosion does form on the studs 36 the contact area, the area of corrosion is so small that any corrosive bond present easily manually may be broken and the bulb removed for replacement.

It may be seen, therefore, that this invention provides an electric lamp mounting assembly that includes a one-piece housing of insulating material that minimizes the number of assembly parts and that retains the conventional, desirable bayonet coupling mounting of the lamp bulb. However, metal to metal contact is minimized and a portion of the bulb is surrounded entirely by insulating material to avoid transmission of vibrations. As in the prior art, the mounting assembly does not include a spring to insure electrical contact with the bulb base terminal, but relies upon the resilient force of the housing material. This resilient force and easy deformation of the germane housing portion is provided despite the fact that the housing material is semi-rigid and wear and impact resistant.

What is claimed:

1. An electric lamp assembly for mounting an electrical bulb having a globe, a cylindrical base, a base terminal insulated from said base and a pair of studs extending radially from said base, said assembly including: an insulating housing formed from semi-rigid material and having a base portion and a sleeve portion interconnected with said base portion, said sleeve adapted to receive telescopically said cylindrical base and completely surround a portion of said base in closely contiguous relationship thereto, said sleeve having a pair of longitudinal slots formed therein, each of said slots adapted to receive one of said studs, a first electrical conductor positioned in one end of said sleeve by resilient means integral with said housing, said electrical conductor adapted to be urged into contact with said base terminal by said resilient means, said first conductor adapted to be interconnected with a source of electrical energy, a second electrical conductor at least partially surrounding said sleeve and including a pair of projections, each of said projections extending into one of said slots and engaging only one of said studs, and electrically conductive fastener means securing said second conductor to said base portion and adapted to interconnect said second conductor to an electrically grounded element.

2. The electric lamp assembly of claim 1, said resilient means comprising an end wall closing one end of said sleeve and having a plurality of cut outs therein to weaken the resistance to deformation of the semi-rigid material of said end wall, said first electrical conductor comprising a button contact within said sleeve and secured to a conductive wire that extends through an aperture in said end wall.

3. The electric lamp assembly of claim 1, said second electrical conductor comprising a sheet metal member having an aperture formed therethrough, said sleeve extending through said aperture and said projections extending into said aperture.

4. The electric lamp assembly of claim 3, said fastener means extending through said member and said housing base and adapted to engage said grounded element exterior of said housing.

5. An electric lamp assembly for mounting an electric bulb having a globe, a cylindrical base, a base terminal insulated from said base and a pair of studs extending radially from said base, said assembly including: an insulating one-piece housing formed from semi-rigid material, a light transmitting lens removably secured to said housing and defining therewith an enclosed space, a cylindrical sleeve integral with said housing and located within said space, said sleeve adapted to receive and completely surround a portion of said base, said sleeve having a pair of longitudinal slots formed therein adapted to receive said studs, a first electrical conductor positioned in one end of said sleeve and adapted to be urged by resilient means integral with said housing into abuttment with said base terminal, said resilient means comprising a sleeve end wall integral with said housing and having a domed configuration extending into said sleeve, plural aperture means formed through said end wall and weakening the resistance to deformation of said material such that said end wall is resiliently deformable, and conductive latching means positioned in said slots and adapted to engage only said studs upon said bulb base being received in said sleeve a distance sufficient to cause resilient deformation of said end wall, said latching means being secured to said housing and adapted for electrical connection to ground.

6. The electric mounting assembly of claim 5, said conductive latching means comprising a sheet metal element having an opening formed therethrough through which said sleeve extends, a pair of projections formed on said elements and extending into said opening, each of said projections capable of being engaged by one of said studs upon resilient deformation of said end wall due to insertion of said base into said sleeve.

7. The electric mounting assembly of claim 6, wherein said latching means comprise fasteners extending through said sheet metal element and housing, at least one of said fasteners engaging electrically grounded structure.

* * * * *